United States Patent [19]

Kondo

[11] Patent Number: 4,497,285

[45] Date of Patent: Feb. 5, 1985

[54] COOLING STRUCTURE FOR INTERNAL COMBUSTION ENGINE

[75] Inventor: Makoto Kondo, Saitama, Japan

[73] Assignee: Honda Giken Kogyo Kabushiki Kaisha, Tokyo, Japan

[21] Appl. No.: 416,425

[22] Filed: Sep. 9, 1982

[30] Foreign Application Priority Data

| | | | |
|---|---|---|---|
| Sep. 9, 1981 | [JP] | Japan | 56-141912 |
| Sep. 11, 1981 | [JP] | Japan | 56-135078[U] |
| Sep. 18, 1981 | [JP] | Japan | 56-138856[U] |

[51] Int. Cl.[3] ..... F01P 1/06

[52] U.S. Cl. ..... 123/41.65; 123/71.7; 123/195 C; 74/606 A; 180/229

[58] Field of Search ..... 123/41.56, 41.7, 195 C, 123/198 E, 41.62, 41.65, 41.66, 41.69; 74/606 R, 606 A; 180/227-231, 217, 219

[56] References Cited

U.S. PATENT DOCUMENTS

| | | | |
|---|---|---|---|
| 3,259,752 | 7/1966 | Honda | 123/41.62 |
| 4,074,590 | 2/1978 | Jörg | 74/606 A |
| 4,169,512 | 10/1979 | Ishikawa et al. | 123/198 E |
| 4,173,951 | 11/1979 | Ishikawa | 123/198 E |
| 4,344,500 | 8/1982 | Kurata et al. | 74/606 R |
| 4,345,664 | 8/1982 | Anno et al. | 180/230 |

*Primary Examiner*—William A. Cuchlinski, Jr.
*Attorney, Agent, or Firm*—Sughrue, Mion, Zinn, Macpeak & Seas

[57] ABSTRACT

A cooling structure for an internal combustion engine, comprises a crankcase for housing an engine crankshaft, a cover defining a cooling chamber between the cover and the crankcase and a transmission case integral with the crankcase. The structure comprises communication passages communicable with the cooling chamber and the transmission case chamber for providing air from the outside through the communication passages to the transmission chamber to suppress the overheating of the transmission unit.

8 Claims, 10 Drawing Figures

COOLING STRUCTURE FOR INTERNAL COMBUSTION ENGINE

BACKGROUND OF THE INVENTION

The present invention relates to an improvement in a cooling structure for internal combustion engines which is integral with a transmission case.

Power transmission units especially for use in automotive internal combustion engines are housed in transmission cases in hermetically sealed condition for waterproof and dustproof purposes. Such an arrangement has been disadvantageous in that the interior of the transmission case is subjected to a temperature rise due to heat generated by a variety of mechanical losses in the power transmission unit, such as heat caused by friction upon slippage between a belt pulley and a belt, and heat due to friction between sliding parts of bearings, and hence the components of a power transmission unit tend to be disadvantageously influenced by such generated heat.

With a crankcase to which a transmission case is integrally joined, the heating of the transmission case puts the latter out of thermal equilibrium. The crankcase as a whole suffers from thermal strain and thermal stress under such a thermally unbalanced condition, with the result that the crankcase will become poor in accuracy of assembly and mechanical strength. The present inventor has made the present invention in an effort to effectively and reasonably eliminate the foregoing difficulties experienced with a crankcase for an internal combustion engine, especially a crankcase integral with a transmission case.

SUMMARY OF THE INVENTION

It is an object of the present invention to provide a cooling structure for an internal combustion engine, which comprises a crankcase for housing an engine crankshaft a transmission case integral with the crankcase and a cover defining a cooling chamber between the cover and crankcase on one side of the engine. The structure comprises communication passages communicable with the cooling chamber and the transmission case chamber for providing air from the outside through the communication passage to the transmission chamber to suppress the overheating of the transmission unit.

It is another object of the present invention to provide a cooling-structure for an internal combustion engine, comprising a communication passage disposed downstream of a cooling fan fixed to an end of a crankshaft and providing communication between a cooling chamber and an interior of a transmission case, the arrangement being that cooling air will be introduced through the communication passage into the transmission case and air as heated is discharged out of the transmission case for thereby effectively discharging out heat generated by friction due to various mechanical losses in the transmission case and hence suppressing the heating of the transmission case to protect an internal power transmission unit against disadvantageous thermal influences and maintain the transmission case and other parts in thermal equilibrium, so that the crankcase can be prevented from being subjected to thermal strain and thermal stress, and can be improved in accuracy of assembly and mechanical strength.

DESCRIPTION OF THE PREFERRED EMBODIMENTS

A preferred embodiment of the present invention will be described in detail with reference to the accompanying drawings.

Figure 1:
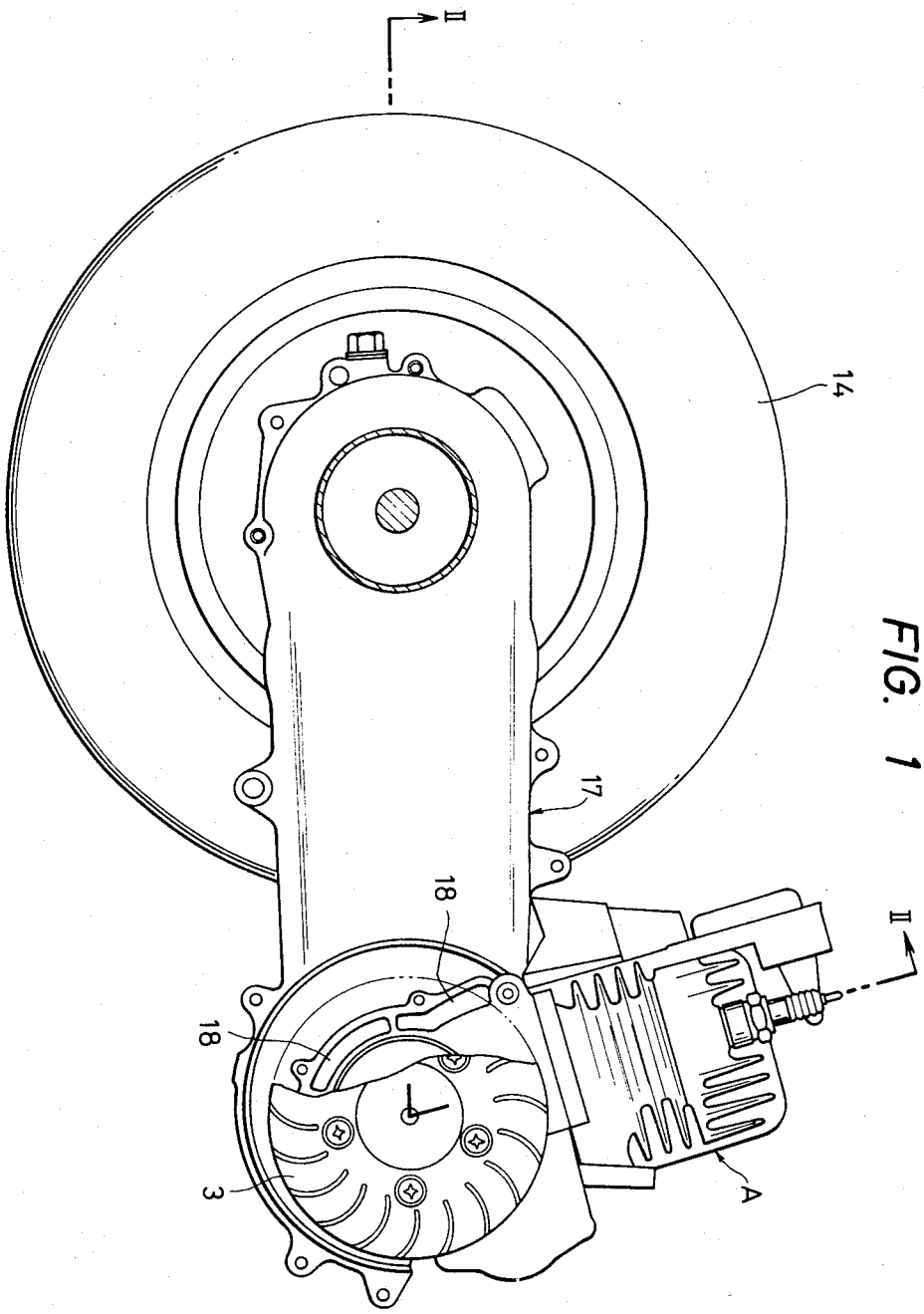
FIG. 1 is a side elevational view, partly cut away, of an automotive internal combustion engine.
Figure 2:
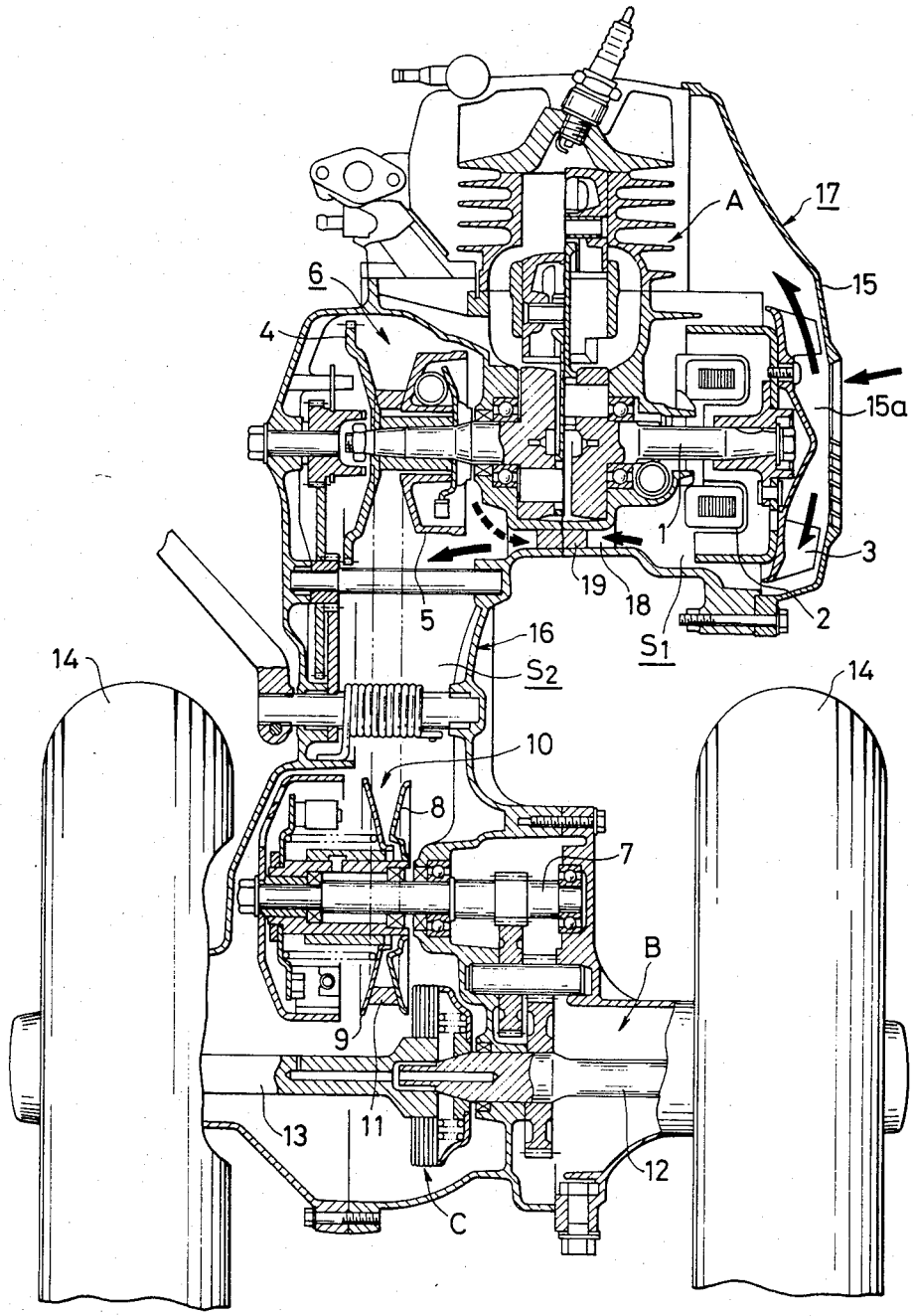
FIG. 2 is a cross-sectional view taken along line II—II of FIG. 1.
Figure 3:
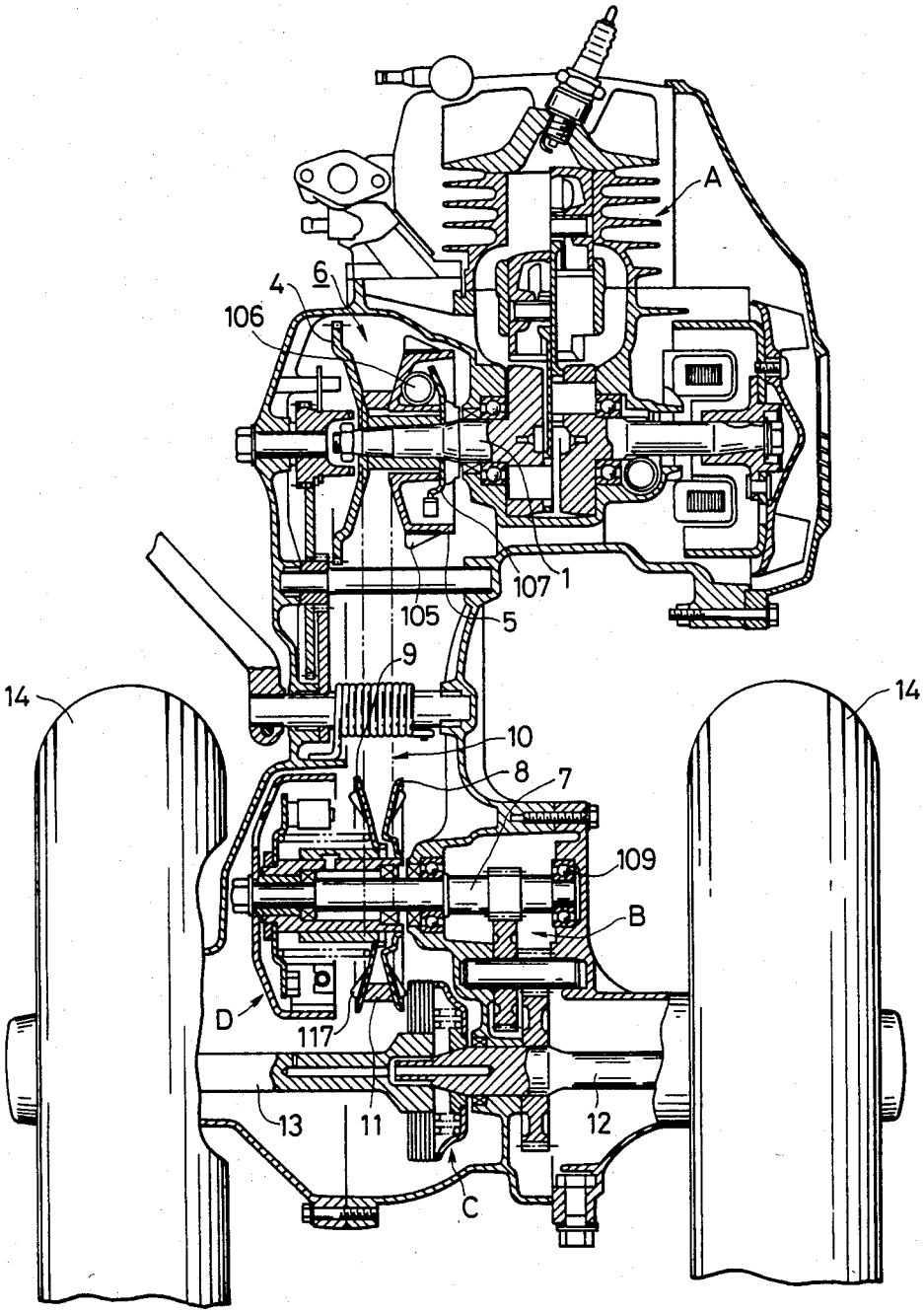
FIG. 3 is a similar cross-sectional view showing another embodiment of the invention.

FIG. 1 is a side elevational view, partly broken away, of an automotive internal combustion engine, and FIG. 2 is a cross-sectional view taken along line II—II of FIG. 1.

In FIG. 2, a crankshaft 1 which is an output shaft of an engine A supports on one end thereof (the righthand end as shown in FIG. 2) a generator 2 and a cooling fan 3 attached thereto and on the other end (the lefthand end as shown in FIG. 2) a variable drive pulley 6 composed of a fixed face 4 and a movable face 5.

A rotatable driven shaft 7 extends parallel to and is disposed horizontally rearward of the crankshaft 1. The driven shaft 7 has a variable driven pulley 10 composed of a fixed face 8 and a movable face 9. A V belt 11 is laid around the driven pulley 10 and the drive pulley 6. The V belt 11, the driven pulley 10 and the drive pulley 6 jointly constitute a known belt-driven automatic transmission device. The driven shaft 7 is coupled by a reduction gear B to an axle 12 which is connected coaxially to another axle 13 by a friction clutch mechanism C. A pair of wheels 14 are mounted respectively on the ends of the axles 12, 13.

The engine A is covered at its lower portion with a cover 15 to define a cooling chamber $S_1$, the cover 15 having an air inlet 15*a* confronting the fan 3. The belt-driven automatic transmission device, the reduction gear B and the friction clutch mechanism C jointly constitute a power transmission unit that is housed in a closed space $S_2$ in a transmission case 16. The transmission case 16 and the cover 15 are integrally joined as shown along a center line of the engine A into an overall outer casing 17 according to the present invention.

The outer casing 17 has communication passages 18 disposed downstream of the cooling fan 3 and providing communication between the cooling chamber $S_1$ and the closed space $S_2$ in the transmission case 16. A filter 19 is installed in each of the communication passages 18.

Operation of the outer casing 17 of the present invention will now be described.

The engine A generates power to rotate its output shaft or the crankshaft 1. Part of the power generated is consumed to drive the generator 2 and the cooling fan 3, and the other is transmitted through the drive pulley 6, the V-belt 11, the driven pulley 10, the driven shaft 7, the reduction gear B and the friction clutch mechanism C to the axles 12, 13, and is eventually consumed to drive the wheels 14.

The power transmission unit housed in the transmission case 16 is subjected, in operation, to frictional heat which is converted from part of the transmitted power by slippage between the V belt 11 and the pulleys 6, 10 and mechanical losses at bearings.

The cooling fan 3 which is coaxially rotated by the crankshaft 1 supplies air through the air inlet 15*a* in the cover 15 in the direction of the arrows indicated by solid lines in FIG. 2 into the cooling chamber $S_1$ to cool the parts accommodated in the cooling chamber $S_1$. Part of the air is introduced through the communication passages 18 and the filters 19 installed therein into the closed space $S_2$ in the transmission case 16. The air thus introduced in the transmission case 16 suppresses the generated heat to prevent mechanical components therein from being heated overly, so that the components will be protected against adverse thermal influences and the temperature in the transmission case 16 will be uniform.

Therefore, the transmission case 16 is continuously supplied with air from the outside. Since the transmission case 16 is closed, the continuous supply of the air causes a progressive pressure in the transmission case 16. When the pressure in the transmission case 16 exceeds the pressure in the cooling chamber $S_1$ upon deceleration, the air as heated by friction of the parts is forced to flow back into the cooling chamber $S_1$ in the direction of the dotted-line arrow in FIG. 2 and then out of the outer casing 17. The temperature in the closed space $S_2$ in the transmission case 16 and that in the cooling chamber $S_1$ are maintained in balance, so that the crankcase will not suffer from the problem of poor accuracy of assembly and reduced mechanical strength which would otherwise result from thermal strain and thermal stress due to unbalanced thermal distribution.

The interior of the transmission case 16 is always kept under a pressure higher than the atmospheric pressure to prevent entry of water and dust into the transmission case 16.

The filters 19 in the communication passages 18 block water that has been carried on the air into the cooling chamber $S_1$ against entry into the transmission case 16. Any water which has been trapped in the cooling chamber $S_1$ can be discharged out through a water drain hole defined in the bottom of the cooling chamber.

While the present invention has been described as being applied to a crankcase for an automotive internal combustion engine, the invention is also applicable to any desired types of engine.

With the arrangement of the present invention as described above, there are provided communication passages disposed downstream of a cooling fan fixed to an end of a crankshaft 1 and providing communication between the cooling chamber $S_1$ and the transmission case 16. Cooling air is introduced via the communication passages 18 into the transmission case 16 and air as heated is discharged out of the transmission case 16. Therefore, frictional heat generated by various mechanical losses in the transmission case 16 can effectively be discharged out to suppress the heating of the transmission case thereby protecting a power transmission unit therein against disadvantageous thermal influences and keeping the transmission case and other parts in thermal balance. The crankcase is thus prevented from undergoing thermal strain and thermal stress, and has an improved degree of accuracy of assembly and mechanical strength.

Another embodiment of the present invention will now be described with reference to FIGS. 3 to 7 in which the same reference numerals and characters used in the first embodiment are used to indicate the like members and components. In the embodiment shown in FIG. 3, there are provided fan rings in order to further enhance the cooling effect in the transmission case 16. As mentioned above, the drive pulley 6 is mounted on one extending end of the crankshaft 1. The drive pulley 6 is composed of the face 4 fixed to the crankshaft 1 and the dish-like movable face 5 which is mounted on the crankshaft 1 by, for example, a spline engagement to be movable in the axial direction but rotatable together with the crankshaft 1 while being confronted with the fixed face 4. On the outer periphery of the movable face 5, there are provided a fan ring 105 as best shown in FIGS. 4 and 5 through, for example, a shrinkage fit process.

Figure 4:
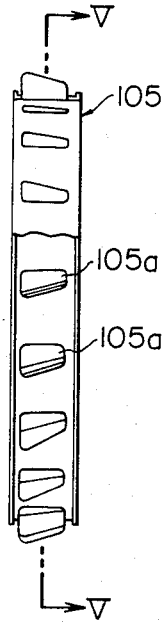
FIGS. 4 and 5 show side and front views of a fan ring shown in FIG. 3.
Figure 5:
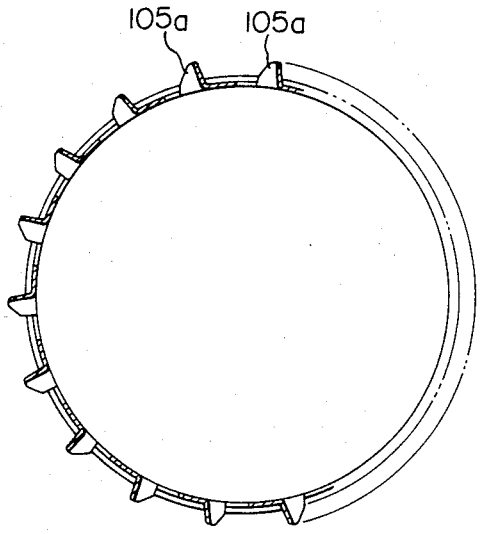

The above described fan ring 105 is formed, as shown in FIGS. 4 and 5, of a steel plate in a ring-shaped. Thereafter, the steel plate is punched and the punched portions are bent outwardly to form a plurality (eighteen in the embodiment) of a rotary vanes 105*a*. The fan ring 105 is fastened to the movable face 5 to be used as a cooling fan.

On the rear side of the movable face 5 there is provided a weight roller 106 which is held by the movable face 5 and a confronting ramp plate 107.

Figure 6:
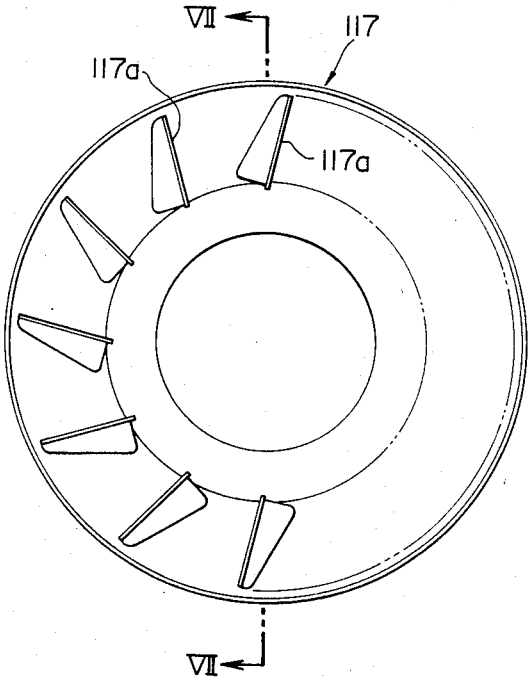
FIGS. 6 and 7 show front and side views of another fan ring shown in FIG. 3.
Figure 7:
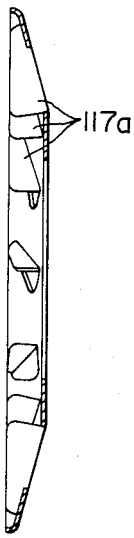

On the driven shaft 7 side, fan rings 117 are fastened on outer peripheries of the fixed face 8 and the movable face 9, respectively, as shown in FIGS. 6 and 7. Each of the fan rings 117 forms a cooling fan in the same manner as described above with a plurality (seventeen in the embodiment) of rotary vanes 117*a* being formed at an equal interval.

Turning to the fan ring 105, another fan ring (not shown) may be provided on the fixed face 4 if there is sufficient space.

In operation, air introduced from the communication passages 18 into the transmission case 16 is effectively forcibly converted to thereby diffuse the generated heat to the outside without local heating of the transmission unit.

According to the present invention, since the fan rings are directly formed on the movable and fixed faces of the pulleys, the transmission unit may be made compact without using special heat-resistive mechanical parts.

Figure 8:
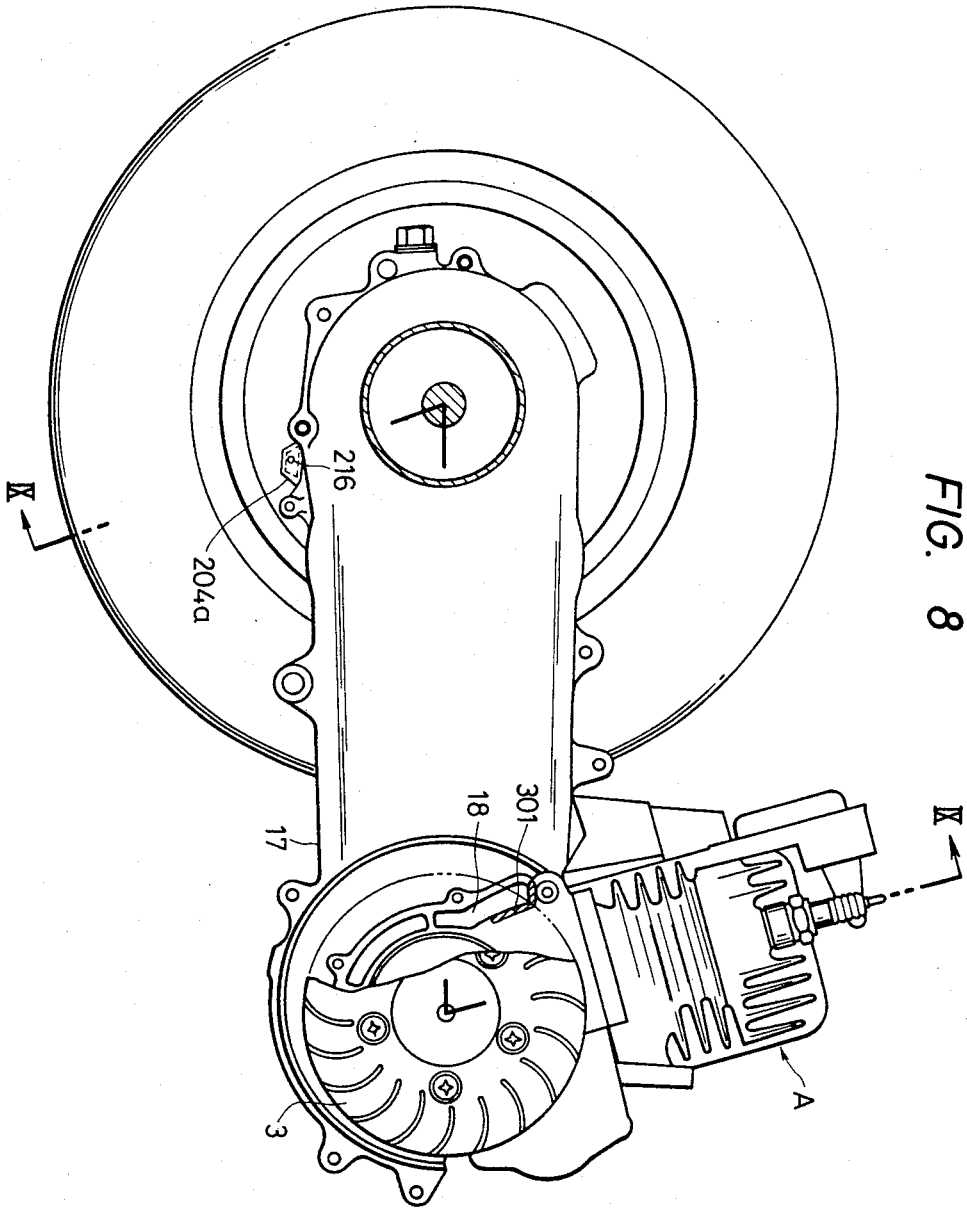
FIGS. 8 and 9 show further modifications of the invention.
Figure 9:
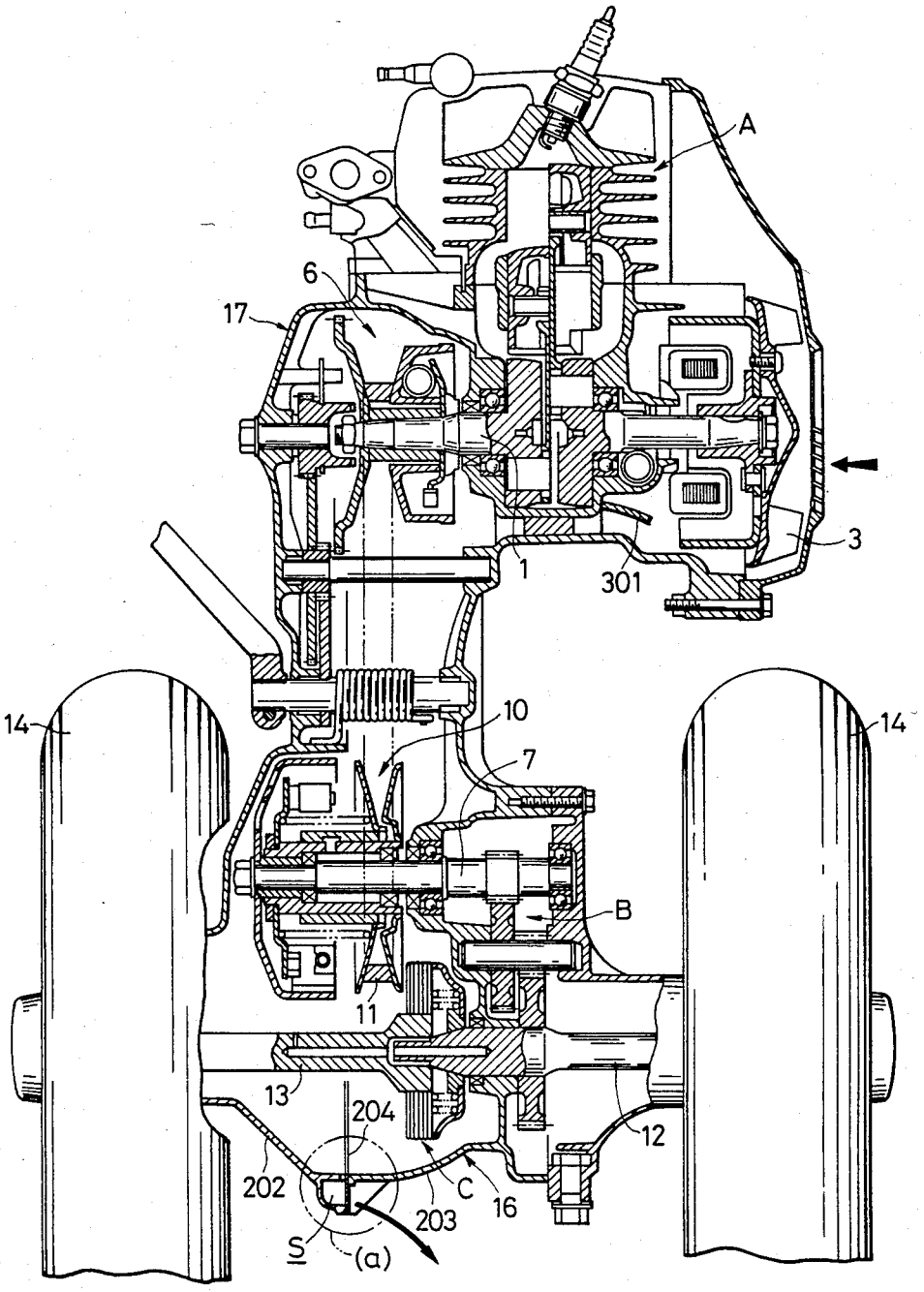
Figure 10:
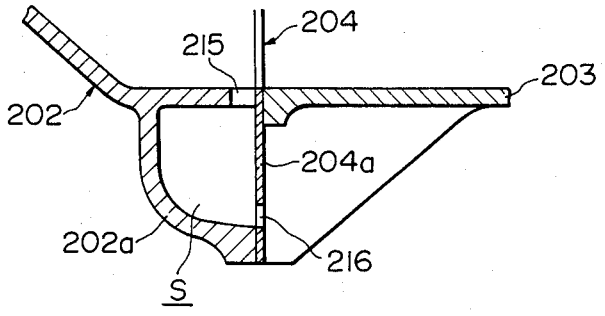
FIG. 10 is a cross-sectional view of the water drain chamber shown in FIGS. 8 and 9.

FIGS. 8 to 10 show a further embodiment of the present invention. On the rear side of the transmission case 16, there is provided a water drain chamber S as shown in FIG. 9. As shown in FIG. 9, the transmission case 16 is composed of a left case half 202 and a right case half 203 which is integral with the outer casing 17. The water drain chamber S is composed of a cup-shaped portion 202*a* which is formed integrally with the left case half 202 and an extending portion 204*a* of a case packing 204. The extending portion 204*a* is adapted to close an opening of the cup-shaped portion 204*a*. A water drain hole 216 is formed in the extending portion 204*a* of the sealing packing 204 and a water drain hole 215 is formed at an end portion of the bottom of the left case half 202. The water drain holes 215 and 216 are formed to be perpendicular to each other.

Water introduced into the transmission case is collected through the water drain hole 215 in the water drain chamber S and is discharged through the water drain hole 216 to the outside. Since the water drain hole 216 is formed vertical, the introduction direction of water and dust into the water drain chamber S is horizontal. Also, since the water drain hole 215 is perpendicular to the introduction direction of water and dust, the entry of water and dust into the transmission chamber may be prevented effectively.

Furthermore, in order to further enhance the efficiency of cooling the transmission case, according to the present invention, a guide wall 301 may be formed as shown in FIGS. 8 and 9. The guide wall 301 extends from a peripheral portion of the upper communication passage 18 toward the cooling fan 3. By this structure, air introduced from the cooling fan 3 is effectively introduced into the transmission unit.

What is claimed is:

1. A cooling structure for an internal combustion engine, comprising a crankcase for housing an engine crankshaft, a substantially closed transmission case integral with said crankcase, and an outside cover defining a cooling chamber between said cover and crankcase, said outside cover and said transmission case being located substantially at both ends of said engine crankshaft, said transmission case incorporating therein power transmission means for an axle, said outside cover incorporating a first air cooling means for introducing atmospheric air from the outside, said cooling chamber and said transmission case communicating with each other through at least one communicating passage, an opening of said communicating passage being positioned inside said outside cover.

2. The structure of claim 1, said communication passage being positioned downstream of said first air cooling means.

3. The structure of claim 1, said crankcase incorporating therein a guide wall for effectively introducing air from said first air cooling means to said transmission case through said transmission passage.

4. A cooling structure for an internal combustion engine, comprising a crankcase for housing an engine crankshaft, a substantially closed transmission case integral with said crankcase, and an outside cover defining a cooling chamber between said cover and crankcase, said outside cover and said transmission case being located substantially at both ends of said engine crankshaft, said outside cover incorporating a first air cooling means for introducing atmospheric air from the outside, said transmission case incorporating therein power transmission means for an axle, said power transmission means including a drive pulley unit arranged on said crankshaft side, a driven pulley unit arranged on the axle side, a drive belt laid around said drive and driven pulley units, and an additional cooling means for further feeding the air introduced by said first cooling means, said cooling chamber and said transmission case communicating with each other through at least one communicating passage, an opening of said communicating passage being positioned inside said outside cover.

5. The structure of claim 4, said additional cooling means including a first air cooling member for cooling an interior of said transmission case, said first air cooling member including at least one fan ring made of a steel plate having a plurality of vanes.

6. The structure of claim 5, said additional cooling means further including a second air cooling member for cooling an interior of said transmission case, said second air cooling member including at least one fan ring made of a steel plate having a plurality of vanes.

7. A cooling structure for an internal combustion engine, comprising a crankcase for housing an engine crankshaft, a substantially closed transmission case integral with said crankcase, and an outside cover defining a cooling chamber between said cover and crankcase, said outside cover and said transmission case being located substantially at both ends of said engine crankshaft, said transmission case incorporating therein power transmission means for an axle, said cooling chamber and said transmission case communicating with each other through at least one communicating passage, an opening of said communicating passage being positioned inside said cover, said cooling structure further including a water drain chamber and said transmission case being composed of first and second case halves which are sealingly coupled to each other through a packing to define a transmission chamber, wherein said water drain chamber is defined by a bottom of said first case half, an extending part of said packing and a cup-shaped portion having an opening and formed integrally with said bottom of said first case half, said drain chamber being communicable with said transmission chamber through a first water drain hole formed at an end portion of said bottom of said first case half and being communicable with the outside through a second drain hole formed at a lower end portion of said packing.

8. The structure of claim 7, said first and second water drain holes are substantially vertical to each other.

* * * * *